US007478848B2

(12) United States Patent
Kim

(10) Patent No.: US 7,478,848 B2
(45) Date of Patent: Jan. 20, 2009

(54) DOOR OPENING PREVENTION DEVICE FOR VEHICLE DOOR OUTER HANDLE

(75) Inventor: Min-Ho Kim, Gyeonggi-Do (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 11/799,226

(22) Filed: Apr. 30, 2007

(65) Prior Publication Data

US 2008/0136199 A1 Jun. 12, 2008

(30) Foreign Application Priority Data

Dec. 12, 2006 (KR) ..... 10-2006-0126342

(51) Int. Cl.
*E05B 3/00* (2006.01)

(52) U.S. Cl. ..... 292/336.3; 292/DIG. 22

(58) Field of Classification Search ..... 292/DIG. 22, 292/336.3, 92, 107, 114, 209
See application file for complete search history.

(56) References Cited

U.S. PATENT DOCUMENTS 543,908 A * 8/1895 Stone ..... 292/32
5,308,130 A * 5/1994 Lee ..... 292/336.3
5,312,143 A * 5/1994 Buckner ..... 292/230
5,865,481 A 2/1999 Buschmann
6,648,382 B1 * 11/2003 Monig et al. ..... 292/336.3

FOREIGN PATENT DOCUMENTS

| | | |
|---|---|---|
| JP | 10-181350 | 7/1998 |
| JP | 2001-303822 | 10/2001 |
| JP | 2002-047844 | 2/2002 |
| JP | 2003-020845 | 1/2003 |

* cited by examiner

*Primary Examiner*—Gary Estremsky
(74) *Attorney, Agent, or Firm*—Edwards Angell Palmer & Dodge LLP; Peter F. Corless

(57) ABSTRACT

The present invention provides a door opening prevention device of a vehicle door outer handle. The door opening prevention device includes: a handle base having a lever mounting part; a lever rotatably mounted on the lever mounting part, having a return spring and having a locking slot formed in a shaft of the lever so as to pass through the shaft; a lever cover mounted on the lever mounting part so as to be provided outside the lever and having an elastic rotary member; a locking arm formed in the elastic rotary member, the locking arm being inserted into the locking slot when the elastic rotary member is rotated. The present device can reliably prevent the door from being opened in the event of a broadside collision.

8 Claims, 8 Drawing Sheets

DOOR OPENING PREVENTION DEVICE FOR VEHICLE DOOR OUTER HANDLE

CROSS-REFERENCE TO RELATED APPLICATIONS

The present application is based on and claims priority from Korean Patent Application Number 10-2006-0126342, filed on Dec. 12, 2006, the disclosure of which is hereby incorporated by reference herein in its entirety.

BACKGROUND OF THE INVENTION

1. Technical Field

The present invention relates to a door outer handle for a vehicle, and more particularly to a door opening prevention device for a vehicle door outer handle.

2. Background Art

A grip type door outer handle has been used in a vehicle door in recent years due to its excellent design and usability. It is, however, more easily pulled in the event of a broadside collision as compared to a lift up type handle. For this reason, a vehicle door having a grip type door outer handle can be more easily opened as compared to that having a lift up type handle.

FIG. 1 illustrates the structure of a prior art door opening prevention device. A lever 2 is interlocked with a door outer handle. The lever 2 is mounted on a handle base 1 so that the door can be unlocked by the rotation of the lever 2. The door outer handle includes a spring 3 for providing a force to return the handle to an original position after operation.

The handle base 1 is provided with a separate control lever 4, which can elastically rotate back and forth depending on the direction of acceleration (impact) that can be applied by a collision. Further, a keyway 2*a* is formed on the shaft of the lever 2 so as to correspond to the both ends of the control lever 4. For this reason, control lever 4 can rotate depending on the direction of acceleration as shown in FIGS. 2A and 2B, so that the end of control lever 4 can be inserted and then locked in the keyway 2*a*. As a result, even when the handle is pulled due to inertia that takes place in the event of a collision, the lever 2 does not rotate, thereby preventing the door from being opened.

The above-described device has disadvantages, however. First, since the lever 2 is rotatably mounted on the handle base 1 by a lever pin 5, the depth of the keyway 2*a* formed on the shaft of the lever 2 is small. For this reason, the locking force between the control lever 4 and the keyway 2*a* is not sufficient. As a result, the control lever 4 can be easily separated from the keyway 2*a*, and the lever 2 can thus rotate, thereby causing the door to be opened. Second, since the control lever 4 is elastically rotated with regard to a portion where it is mounted on the handle base 1, the rotation path of the control lever 4 is irregular and unstable depending on the impact (acceleration). Third, since the control lever 4 is unstably mounted on the handle base 1, the control lever 4 can be easily separated from the handle base 1 when an impact is applied, which makes it hard to prevent the door from being opened.

There is thus a need for a new door opening prevention device that can overcome the above-described problems.

SUMMARY OF THE INVENTION

The present invention has been made to provide a device for reliably and stably preventing a vehicle door from being opened in the event of a broadside collision.

In one aspect, the present invention provides a door opening prevention device comprising: a handle base having a lever mounting part; a lever rotatably mounted on the lever mounting part, having a return spring and having a locking slot formed in a shaft of the lever so as to pass through the shaft; a lever cover mounted on the lever mounting part so as to be provided outside the lever and having an elastic rotary member; and a locking arm formed in the elastic rotary member, the locking arm being inserted into the locking slot when the elastic rotary member is rotated.

In a preferred embodiment, the lever mounting part has a substantially rectangular shape. The lever mounting part has shaft supporting grooves formed on the inner surface thereof so that both ends of the shaft are rotatably supported by the lever mounting part.

Preferably, the lever cover has a body in a substantially rectangular box shape so that the lever mounting part is inserted into the body. The body may preferably have hook holes and the lever mounting part may preferably have hooks. The hooks are locked in the hook holes.

Also preferably, the elastic rotary member is formed in the body so that one end of the elastic rotary member is integrally formed with the body.

Suitably, the elastic rotary member may comprise a flat plate at one side portion thereof so as to be perpendicular to a rotational direction.

In another preferred embodiment, the body and the elastic rotary member of the lever cover may be separately formed.

In this embodiment, the body has on its upper surface protrusions with pinholes defined therein. The elastic rotary member is provided with pins integrally formed therein so that the pins are inserted into the pinholes. Each of the pins is provided with a spring the ends of which are fixed to the protrusion and the elastic rotary member.

Preferably, the pinhole has at its upper portion an opening which can be elastically deformed when the pin is inserted into the pinhole.

In another aspect, motor vehicles are provided that comprise a described device.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present device will be particularly useful with a wide variety of motor vehicles.

Other aspects of the invention are discussed infra.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Hereinafter, preferred embodiments of the present invention will be described with reference to accompanying drawings.

Figure 1:
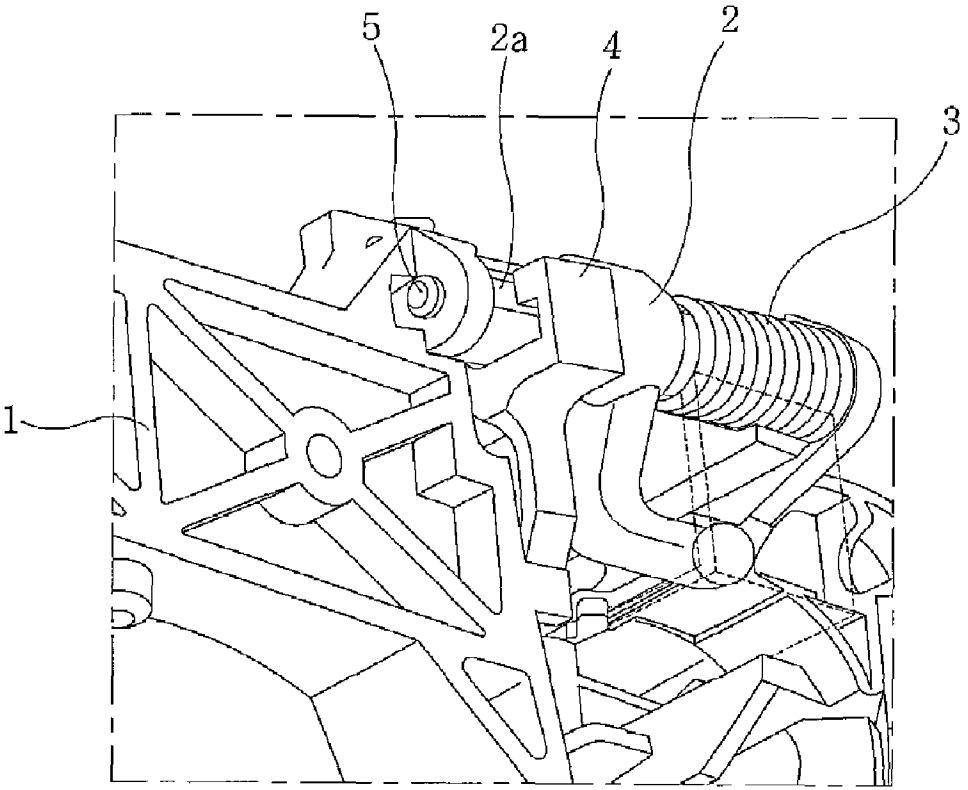
FIG.1 PRIOR ART
FIG. 1 is a perspective view of a prior art door opening prevention device for a vehicle door outer handle.
Figure 2:
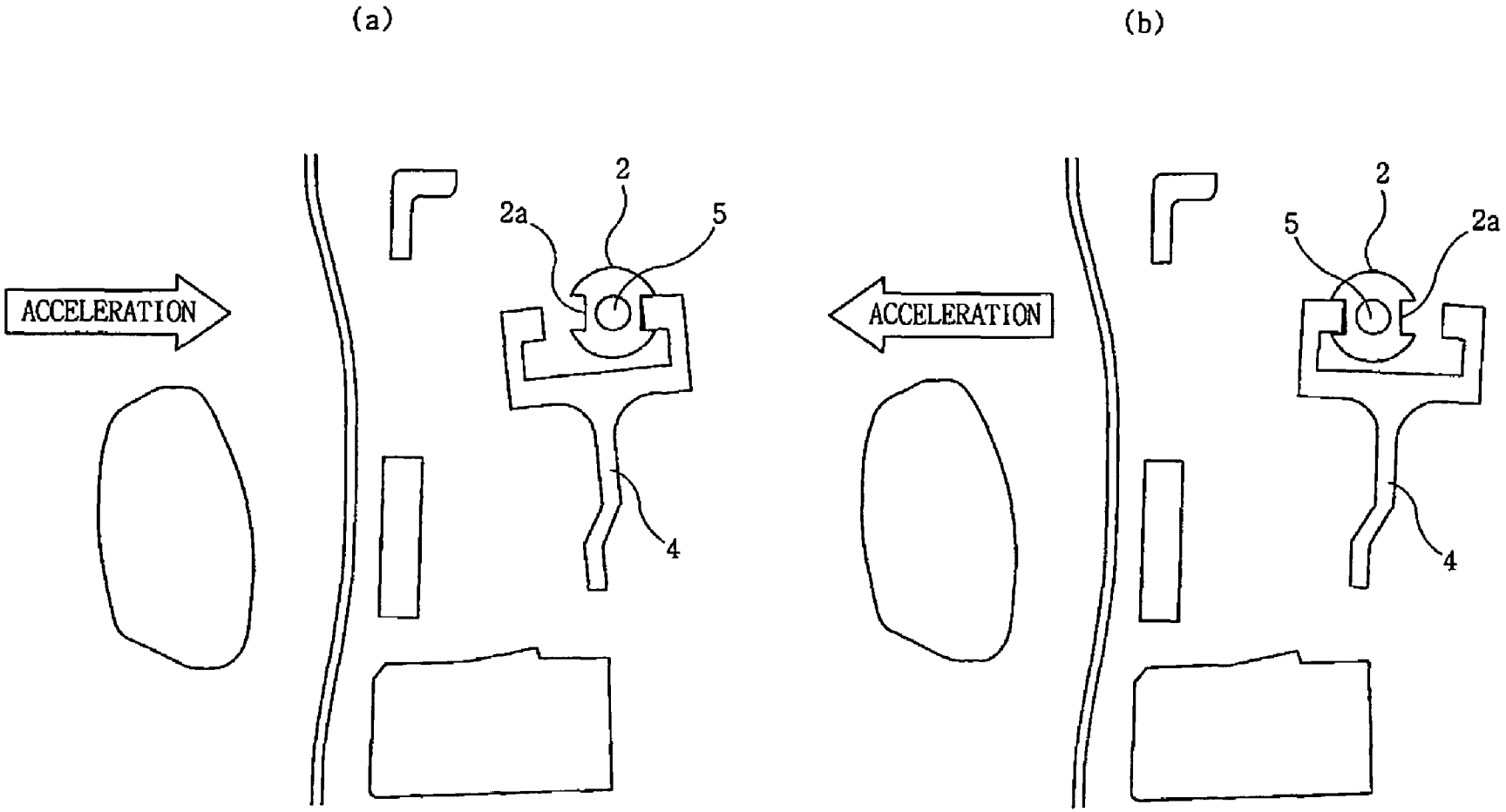
FIG. 2 is a view illustrating the operation of the device shown in FIG. 1.
Figure 3:
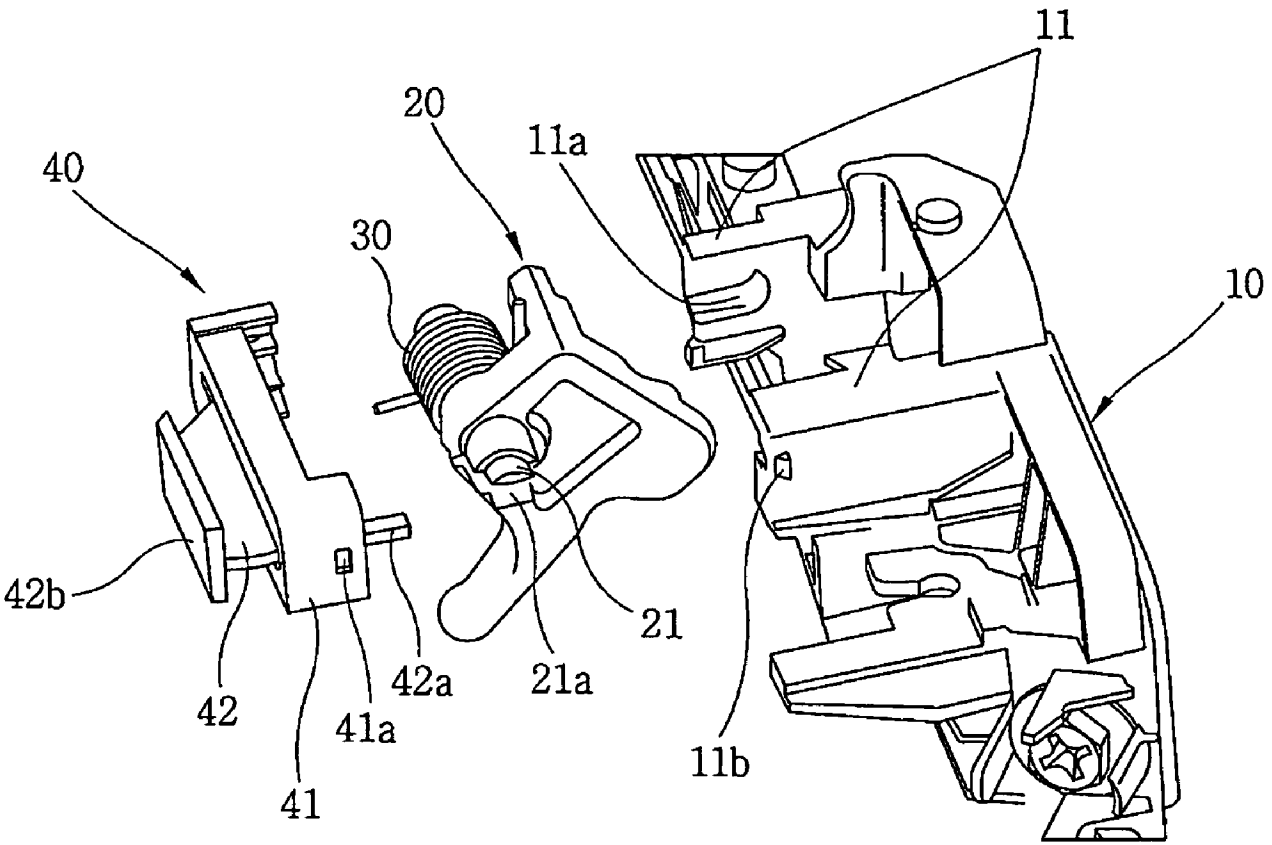
FIG. 3 is an exploded perspective view of a door opening prevention device according to a preferred embodiment of the present invention.

FIG. 3 is an exploded perspective view of a door opening prevention device according to a preferred embodiment of the present invention. The device includes a handle base 10, a lever 20 rotatably mounted on the handle base 10, a return spring 30 for returning the lever 20, and a lever cover 40 that is mounted on handle base 10 and prevents separation of the lever 20.

A lever mounting part 11 having a rectangular shape protrudes from the handle base 10. The lever mounting part 11 has shaft supporting grooves 11*a* formed on the inner surface thereof. The shaft supporting grooves 11*a* support the both ends of a shaft 21 of the lever 20. That is, the lever 20 is mounted on the handle base 10 so that the both ends of the shaft 21 can be rotated in the shaft supporting grooves 11*a*.

Figure 4:
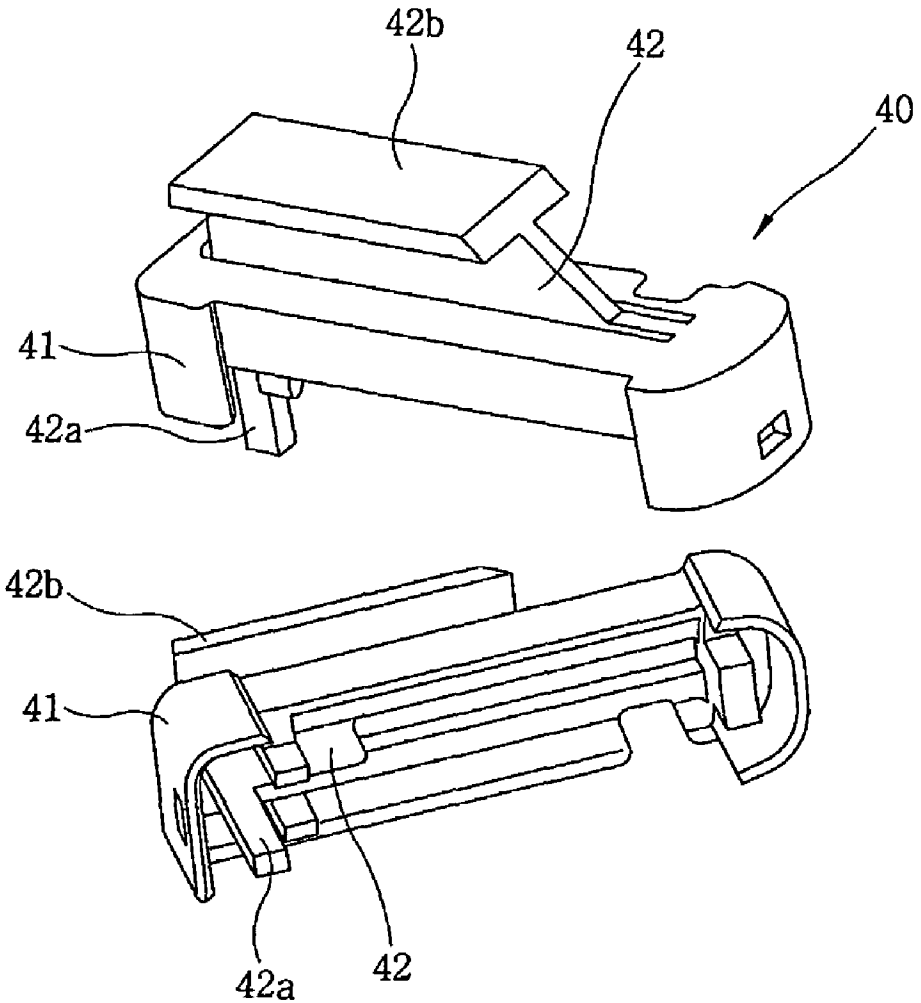
FIG. 4 is a perspective view of a lever cover of a door opening prevention device according to a preferred embodiment of the present invention.

The lever cover 40 is fitted to the lever mounting part 11 from the outside of the lever 20. The lever cover 40 includes a body 41 having a substantially rectangular box shape as shown in FIG. 4, and the lever mounting part 11 can be inserted into the inside of the lever cover 40. Further, hook holes 41*a* are formed on side surfaces of the lever cover 40, hooks 11*b* formed on the outer surfaces of the lever mounting part 11 can be locked in the hook holes 41*a*. By these arrangements, the lever cover 40 can be prevented from being separated from the lever mounting part 11 (referring to FIG. 7).

An elastic rotary member 42 is formed in the body 41 of the lever cover 40. One end of the elastic rotary member 42 is formed integrally with the body 41, and the elastic rotary member 42 can be elastically rotated with respect to the body 41 back and forth. A locking arm 42*a* protrudes from a side portion of the elastic rotary member 42 toward the lever 20. A flat plate 42*b* is formed on the opposite side portion of the elastic rotary member 42 so as to be perpendicular to a rotational direction.

Figure 5:
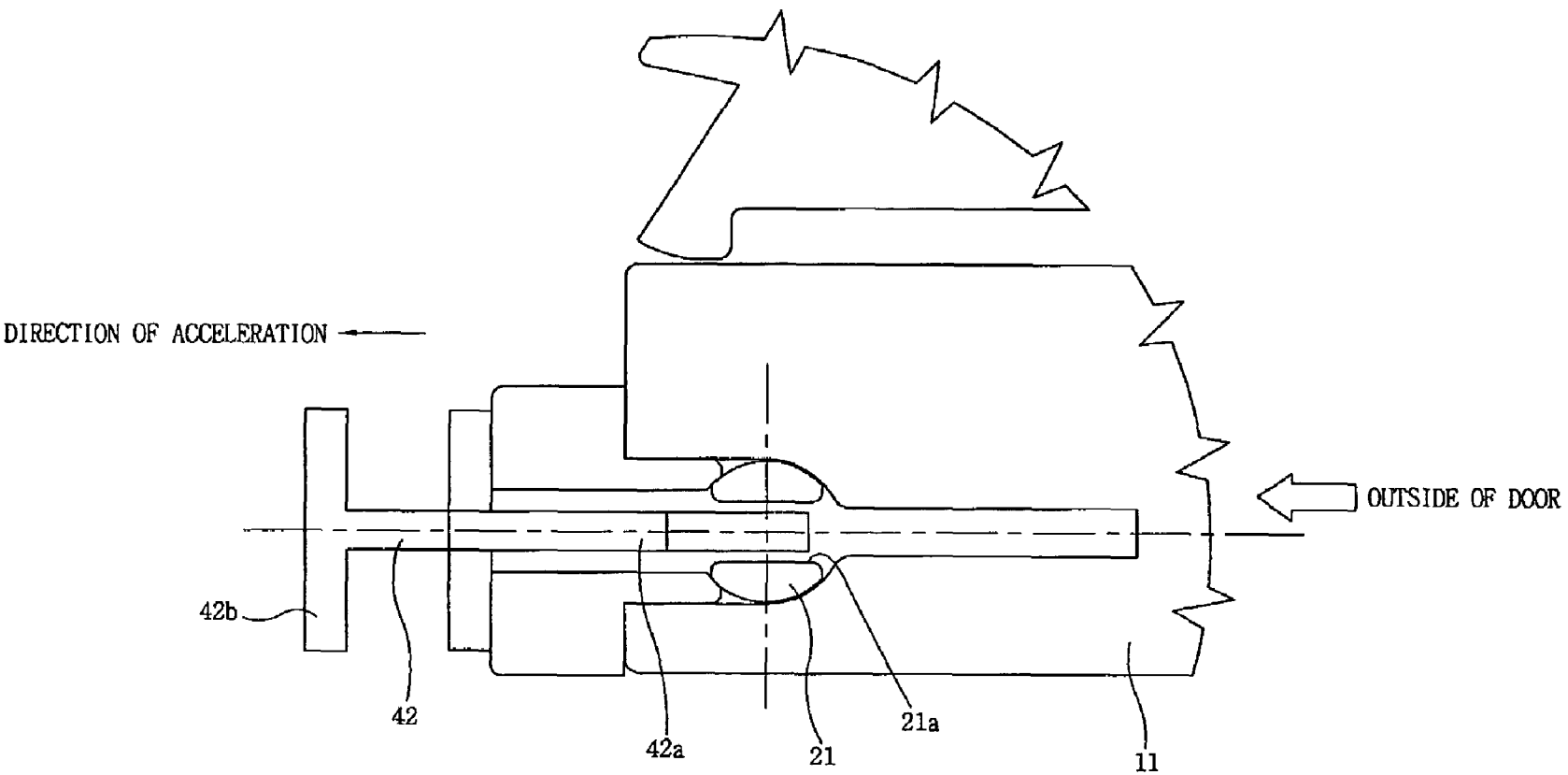
FIG. 5 is a cross-sectional view of a door opening prevention device according to a preferred embodiment of the present invention.

Further, a locking slot 21*a* is formed in the shaft 21 of lever 20, which is corresponding to the locking arm 42*a* at the same height as the elastic rotary member 42. Accordingly, as shown in FIG. 5, when the elastic rotary member 42 is rotated toward the lever 20, the locking arm 42*a* is inserted and locked in the locking slot 21*a*.

Figure 6:
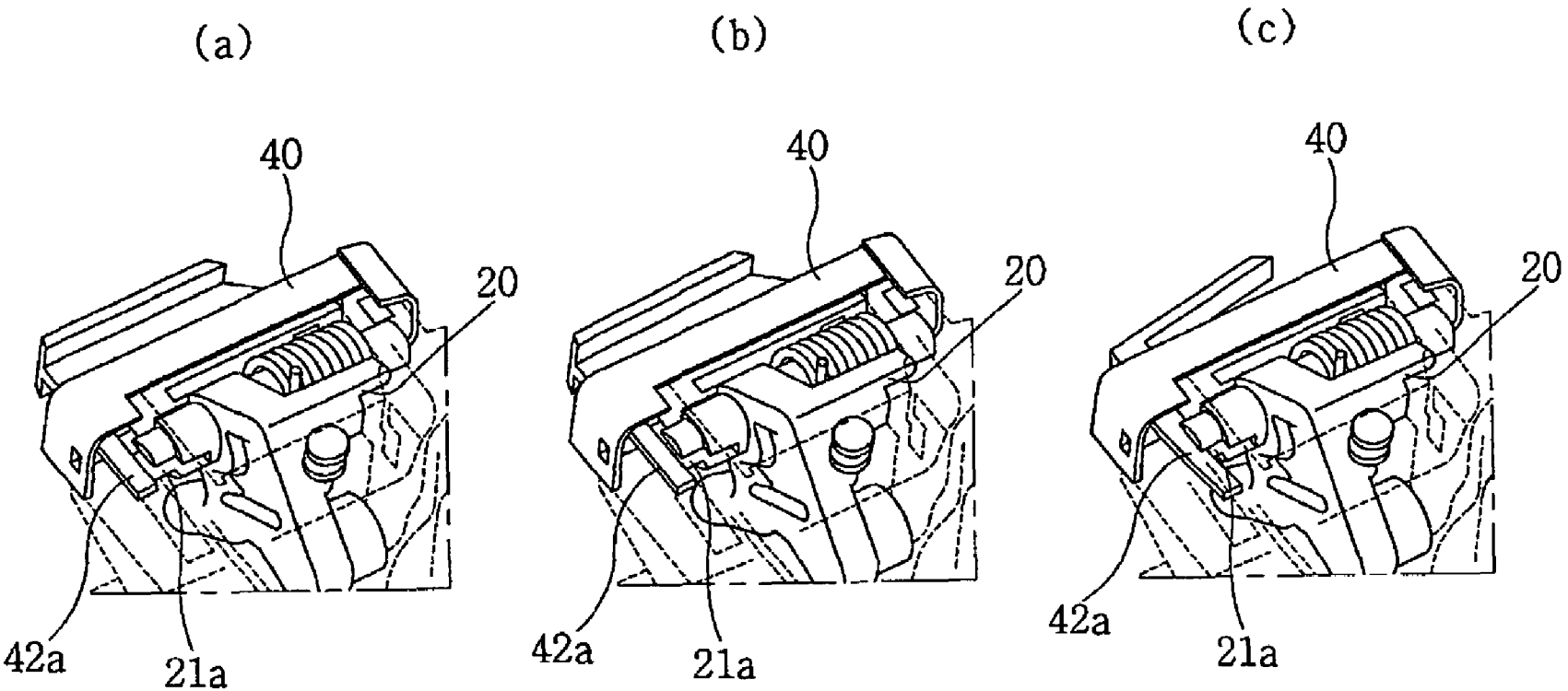
FIGS. 6A, 6B, and 6C are perspective views of a door opening prevention device according to a preferred embodiment of the present invention to illustrate the operation of the device.

Hereinafter, the operation of the device according to a preferred embodiment of the present invention will be described with reference to FIGS. 5 to 7.

When a broadside collision occurs and an impact is applied from the outer side of a vehicle door, the deformation of a door panel and acceleration toward the inner side of the vehicle occur in a door outer handle assembly.

In this case, the elastic rotary member 42 is stopped due to inertia, and the handle assembly is moved toward the elastic rotary member 42 as described above. As a result, the locking arm 42*a* of the elastic rotary member 42 is inserted into the locking slot 21*a* formed in the shaft 21 of the lever 20. The procedures thereof are sequentially illustrated in FIGS. 6A, 6B, and 6C.

Since the locking arm 42*a* is locked in the locking slot 21*a*, the lever 20 is not rotated even though an upward rotational force is applied to the handle (grip) due to the impact occurring in a collision. As a result, the locked state of the door is maintained, which prevents the door from being opened.

Figure 7:
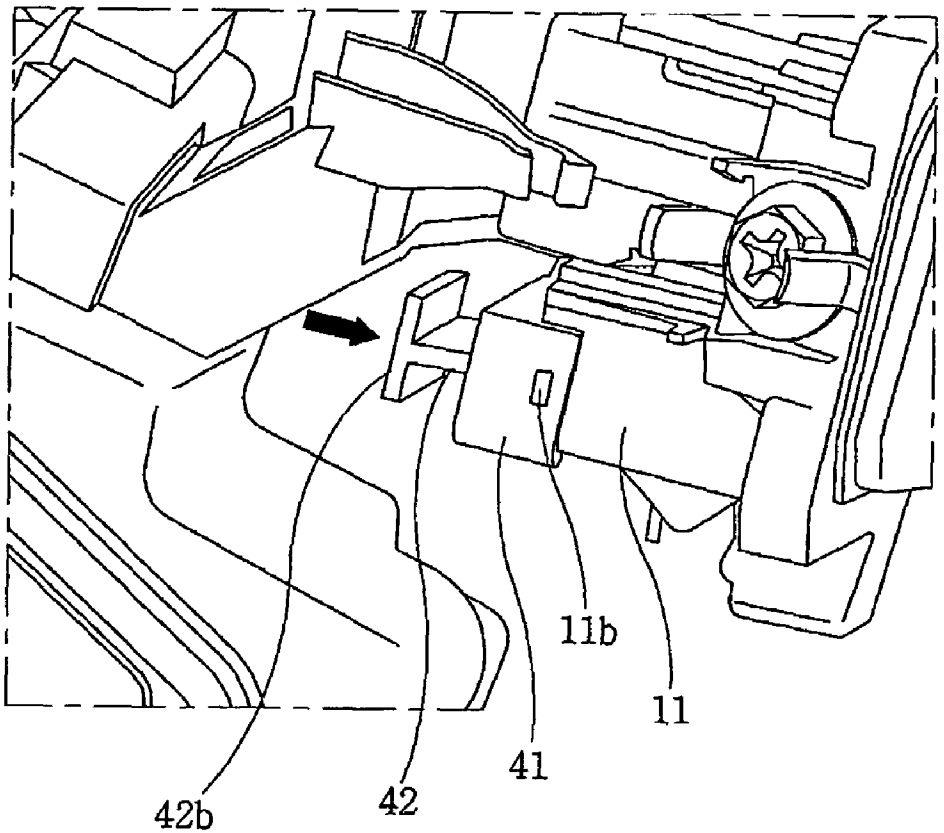
FIG. 7 is a perspective view of a door opening prevention device according to a preferred embodiment of the present invention.

Further, when the components of the door are deformed toward the door outer handle assembly due to the deformation of the door caused by the impact, the deformed components directly press the flat plate 42*b* of the elastic rotary member 42 as shown in FIG. 7. Therefore, the locking arm 42*a* is pushed into the locking slot 21*a*.

Accordingly, even though an external force is applied to the handle upwardly, the lever 20 cannot be rotated. As a result, since the door is not unlocked, the locked state of the door is maintained.

That is, according to a preferred embodiment of the present invention, the lever 20 is mounted on the handle base 10, and the lever cover 40 is then mounted so as to prevent the separation of lever 20. Further, when acceleration occurs in a collision, the locking arm 42*a* is locked in the locking slot 21*a* due to the shape of the lever cover 40, that is, the shape of the elastic rotary member 42. As a result, the handle does not operate, which makes it possible to prevent the door from being opened. In addition, when the handle base 10 is pushed toward the handle due to the deformation of the door panel, the locking arm 42*a* of the elastic rotary member 42 prevents the lever 20 from being rotated similar to the deformation caused by the acceleration. As a result, it is possible to prevent the door from being opened.

Figure 8:
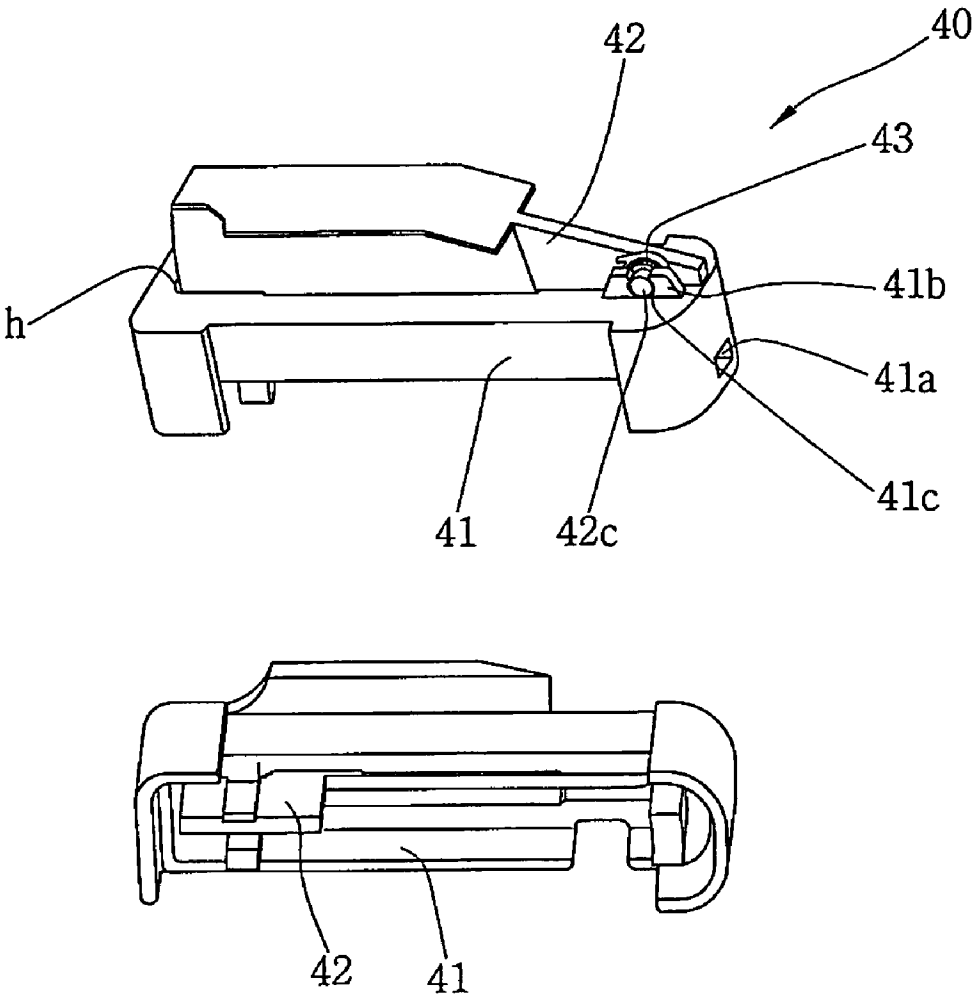
FIG. 8 is a perspective view of a lever cover of a door opening prevention device according to a preferred embodiment of the present invention.

In another preferred embodiment, a lever cover may be formed as shown in FIG. 8. That is, since the body 41 and the elastic rotary member 42 are separately formed, the elastic rotary member 42 can be rotatably mounted on the body 41.

For this, protrusions 41*b* protrude from the upper surface of the body 41 at one end thereof so as to be provided on the both sides of a hole (which is formed at the center of the upper surface of the body, and into which the elastic rotary member 42 is rotatably inserted) for the elastic rotary member 42. Further, a pinhole 41*c*, which is opened upward, is formed at the center of each of the protrusions 41*b*.

In addition, pins 42*c*, which are inserted into the pinholes 41*c* of the protrusions 41*b*, are integrally formed on both surfaces of the end of the elastic rotary member 42.

The pins 42*c* can be press-fitted through the openings formed at the upper portions of the pinholes 41*c*. In this case, since the mouths of the openings are widened due to their elasticity, the pins 42*c* can be inserted into the pinholes 41*c*. After the insertion, the mouths return to the initial state. It is thus possible to prevent the separation of pins 42*c*.

While pins 42*c* are inserted into pinholes 41*c* as described above, the elastic rotary member 42 is not maintained in the state shown in the drawing, and freely rotated. Further, a spring 43 is provided in the lever cover so that the pin 42*c* is inserted into the spring 43 and both ends of the spring are fixed to the protrusion 41*b* and the elastic rotary member 42.

Accordingly, when an external force is not applied, the flat plate 42*b* is parallel to the upper surface of body 41 as shown in the drawing (which is an initial state). When a broadside collision occurs, the spring 43 is deformed due to acceleration and impact directly applied to the panel and inner components and the flat plate 42*b* is rotated. As a result, the lever 20 is not operated.

As described above, since the elastic rotary member 42 and the body 41 are separately formed and the elastic rotary member 42 is rotated with respect to the pins 42*c*, the elastic rotary member 42 can be stably rotated along a consistent rotation path as compared to when the elastic rotary member 42 is deformed and rotated. As result, the lever 20 is accurately inserted into the locking slot 21*a*, which makes it possible to improve operational reliability.

Further, permanent deformation and breakage less occur in an elastically deformed portion as compared to when the elastic rotary member and the body are integrally formed, which makes it possible to improve durability.

Since a lever pin of the prior art device is not used in the present invention, a locking slot is formed to pass through the shaft of the lever, which makes it possible for the locking arm to be reliably and firmly locked in the locking slot.

Further, since the lever cover is firmly mounted on the lever mounting part of the handle base due to the locking structure using hooks, it is possible to prevent the separation of components caused by an impact occurring in a collision. Further, since the elastic rotary member is stably rotated by a direct impact or acceleration, it is possible to improve locking reliability between the locking arm and the locking slot.

That is, according to the present invention, since the mounting stability and operational stability of components are improved, it is possible to prevent a door from being opened.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A door opening prevention device for a vehicle door outer handle, the device comprising:

a handle base having a lever mounting part;

a lever rotatably mounted on the lever mounting part;

a locking slot formed at one end of a shaft of the lever so as to pass through the shaft;

a return spring biasing the lever to the handle base rotatably;

a lever cover mounted on the lever mounting part so as to be provided outside the lever;

an elastic rotary member being integrally formed with the lever cover at one end so as to rotate with respect to the lever cover; and a locking arm formed in the elastic rotary member, the locking arm being inserted into the locking slot when the elastic rotary member is rotated.

2. The door opening prevention device as defined in claim 1, wherein the lever mounting part has a substantially rectangular shape and comprises shaft supporting grooves formed on the inner surface thereof so that both ends of the shaft are rotatably supported by the lever mounting part.

3. The door opening prevention device as defined in claim 1, wherein the lever cover has a body in a substantially rectangular box shape so that the lever mounting part is inserted into the body and wherein the body has hook holes formed therein and the lever mounting part has hooks formed therein so that the hooks are locked in the hook holes.

4. The door opening prevention device as defined in claim 3, wherein the elastic rotary member is formed in the body so that one end of the elastic rotary member is integrally formed with the body.

5. The door opening prevention device as defined in claim 4, wherein the elastic rotary member comprises a flat plate at one side portion thereof so as to be perpendicular to a rotational direction.

6. The door opening prevention device as defined in claim 3, wherein the body and the elastic rotary member of the lever cover are separately formed.

7. The door opening prevention device as defined in claim 6, wherein the body is provided with, on its upper surface, protrusions having pinholes defined therein, the elastic rotary member is provided with pins integrally formed therein so that the pins are inserted into the pinholes, and each of the pins is provided with a spring the ends of which are fixed to the protrusion and the elastic rotary member.

8. The door opening prevention device as defined in claim 7, wherein the pinhole has, at its upper portion, an opening which can be elastically deformed when the pin is inserted into the pinhole.

* * * * *